United States Patent [19]

Martin

[11] 4,414,916

[45] Nov. 15, 1983

[54] AUTOMATIC TONING APPARATUS HAVING A VERTICALLY RECIPROCATING HOPPER

[75] Inventor: Jose V. Martin, Newark, Del.

[73] Assignee: E. I. Du Pont de Nemours & Co., Wilmington, Del.

[21] Appl. No.: 265,445

[22] Filed: May 20, 1981

[51] Int. Cl.[3] ..... B05C 11/02; B05C 19/00

[52] U.S. Cl. ..... 118/612; 118/120; 118/413; 118/415; 222/161

[58] Field of Search ..... 118/612, 443, 120, 415, 118/308, 636; 222/161

[56] References Cited

U.S. PATENT DOCUMENTS

| | | | |
|---|---|---|---|
| Re. 27,876 | 1/1974 | Hudson et al. | 222/181 |
| 367,424 | 8/1887 | Merrill | 118/413 X |
| 2,141,903 | 12/1938 | Brundage | 210/287 |
| 3,104,184 | 9/1963 | Wengenroth, Jr. | 118/310 |
| 3,124,482 | 3/1964 | Olden | 118/637 |
| 3,320,879 | 5/1967 | Edwards et al. | 101/335 |
| 3,379,175 | 4/1968 | Spencer | 118/636 |
| 3,399,070 | 8/1968 | Scharf | 117/4 |
| 3,596,807 | 8/1971 | Hudson et al. | 222/202 |
| 3,636,924 | 1/1972 | Weiler | 118/629 |
| 3,670,701 | 6/1972 | Weiler | 118/637 |
| 3,932,035 | 1/1976 | Sato et al. | 355/3 R |
| 3,946,910 | 3/1976 | Case | 222/238 |
| 3,980,047 | 9/1976 | Cohen et al. | 118/608 |
| 4,019,821 | 4/1977 | Sandner | 401/4 |
| 4,069,791 | 1/1978 | Tobias | 118/120 |

FOREIGN PATENT DOCUMENTS

| | | | |
|---|---|---|---|
| 1177527 | 9/1964 | Fed. Rep. of Germany | 118/413 |
| 50500 | 9/1966 | German Democratic Rep. | 222/161 |
| 907638 | 10/1962 | United Kingdom | 118/415 |

*Primary Examiner*—Evan K. Lawrence

[57] ABSTRACT

An apparatus for applying particulate toner to an image-defining tacky surface upon a photo-element includes a hopper for receiving a particulate toner therein, the hopper being disposed above a transport path along which the photo-element is conveyed. The hopper has a slot extending substantially transversely to and communicating with the transport path. The apparatus is characterized by a reciprocating device for vertically moving the hopper in a reciprocating fashion toward and away from the transport path to impart vibrational energy to the toner to fluidize the same and cause the toner to flow through the slot to form a toner pool, from which pool toner is depositable on a photo-element being transported therebeneath. A toning pad attached to the hopper pats into the photo-element toner that has been deposited from the pool onto the photo-element.

22 Claims, 7 Drawing Figures

AUTOMATIC TONING APPARATUS HAVING A VERTICALLY RECIPROCATING HOPPER

TECHNICAL FIELD

This invention relates to apparatus for applying particulate toners to image-defining tacky surfaces provided on photosensitive elements.

BACKGROUND ART

In the graphic arts photosensitive tacky-surfaced elements are used to define images and, particularly, multicolor images. A photosensitive element is first given an image-wise exposure resulting in the element exhibiting different degrees of tackiness in the exposed and unexposed areas. Following the image-wise exposure the latent image is developed by the application of particulate material, called toner, onto the surface. The tacky image area on the element causes toner to adhere thereto, thus developing the image. Thereafter excess toner particles are removed from the surface.

In contrast to the so-called xerographic toners which exhibit relatively free flowing characteristics, the particulate toner material used in conjunction with the developing system above discussed is characterized by its agglomerating tendencies. As a result, such toners are difficult to handle and tend to cake or resist flow. A variety of devices have been developed whereby such particulate toner may be applied to and removed from the tacky surfaces of the photo-element. Exemplary of a manually operable device for applying controlled quantities of the finely divided particulate toner is the device disclosed in U.S. Pat. No. 3,980,047 (Cohen et al.). U.S. Pat. No. 4,019,821 (Sandner) also discloses a manually operable toner applicator.

U.S. Pat. No. 4,069,791 (Tobias) is representative of an automated apparatus for applying particulate material to the image-wise tacky surface of a photo-element. The photo-element is carried along a transport path to a position beneath a toner hopper. The particulate material is dispensed from the hopper, the hopper having a sidewall which vibrates transversely to the direction of movement of the photo-element. The photo-element is then moved under a toner applicator which includes a brush pad oscillating transversely to the direction of movement of the photo-element to embed the particulate toner into the surface. A second agitating member oscillating transversely of the direction of movement of the photo-element removes excess toner from the photo-element.

The device shown in copending application Ser. No. 64,396, filed Aug. 6, 1979 in the name of Herbert Tobias, also discloses an apparatus for applying toner to the tacky surface of a photo-element. In this device the element advances through the apparatus between a pair of plates covered with pile fabrics. The fibers in the pile fabrics are slanted in the direction of advance of the photo-element. One of the plates is reciprocated in a direction parallel to the direction of advance of the element to thereby impart movement to the element. As the element passes beneath a hopper rotary motion is imparted to an applicator roll which dispenses particulate toner onto the surface of the photo-element.

Since the toner particles have a tendency to agglomerate and resist flow, it is advantageous to provide a toning apparatus wherein the hopper is vertically reciprocated toward and away from the transport path to fluidize the toner particles to faciliate flow thereof.

Moreover, since it is believed that a "vertical patting" motion is most advantageous in embedding toner into the tacky surfaces on the photo-element, it is believed to be of advantage to utilize the vertical reciprocating motion imparted to the hopper to embed the toner into the tacky surfaces on the photo-element.

SUMMARY OF THE INVENTION

The instant invention relates to an apparatus for applying particulate toner to an image-defining tacky surface on a photo-element. The apparatus includes a transport system (such as an endless flat belt) for transporting a photo-element along a predetermined transport path. The transport path extends beneath a hopper adapted to receive a particulate toner therein. The hopper is provided with an orifice, or slot, communicating with the transport path. The slot dimension, measured along the direction of transport of the photo-element, is preferably adjustable. The slot splits the hopper into a first and second segments. One of the segments is fixed while the other is movable with respect to the first segment. Means is provided for moving the movable segment with respect to the fixed segment to thereby vary the dimension of the slot as measured in the direction of travel of the photo-element.

A reciprocating device is attached to the hopper for moving the same in a vertically reciprocating fashion toward and away from the transport path to thereby impart vibrational energy to the toner disposed within the hopper. The oscillatory motion of the hopper fluidizes the toner therein to cause the same to flow through the slot to form a toner pool. From the pool so formed toner is depositable on a photo-element being transported therebeneath.

The reciprocating oscillatory motion is also imparted to a toning pad disposed on the segment of the hopper downstream of the slot such that the toner is "patted", using a "vertical patting" motion, into the tacky surface of the photo-element. A suitable support plate or rigid planar surface is disposed beneath the transport belt vertically opposite the toning pad to provide a stable surface against which the toner may be patted into the photo-element. Disposed intermediate of the slot and the toning pad is a transversely extending seal arrangement. The seal arrangement is fixed with respect to hopper and is adapted to prevent excessive migration of toner from the pool to the toning pad.

The reciprocating device preferably takes the form of a Scotch yoke mechanism selected to impart simple harmonic oscillatory motion to the hopper and the toner therein. The frequency of oscillation of the hopper is within the range from 0 to 50 Hertz (3000 cycles per minute) ($0 < \text{frequency} \leqq 50$ Hertz), preferably 30 to 50 Hertz ($30 \leqq \text{frequency} \leqq 50$ Hertz), and most preferably 40 Hertz with vibratory amplitudes of the hopper in the range from 0 to 0.15 inches peak-to-peak ($0 < \text{amplitude} \leqq 0.150$ inches), preferably 0.020 to 0.100 inches ($0.020 \leqq \text{amplitude} \leqq 0.100$ inches), and most preferably 0.030 inches. These ranges of frequency and amplitude serve to fluidize the toner in the hopper. If the same oscillatory motion imparted to the hopper is also desired to be used to vertically pat the toner into the photo-element, the oscillation frequency is in the range 20 to 50 Hertz ($20 \leqq \text{frequency} \leqq 50$ Hertz), preferably 40 Hertz (2400 cycles per minute), with the amplitude of oscillation (peak-to-peak) being in the range from 0.020 to 0.050 inches (0.020 ≦amplitude≦0.050 inches), preferably 0.030 inches.

The hopper is vertically adjustable with respect to the transport path.

As an option, an agitator could be disposed centrally and axially through the hopper for the purpose of assisting in the fluidization of the toner and in controlling the stratification of toner particles within the hopper. If one is used, the agitator preferably takes the form of a central shaft having agitating arms extending radially outwardly therefrom. The arms terminate in flapper members, or paddles, which extend from the shaft to a radial dimension such that the paddles sweep the inside of the hopper as they are rotated within the hopper. The agitating arms are arranged in a helical pattern on the shaft, the pattern emanating from the axial center of the shaft transversely toward the axial ends thereof. The helical pattern of the agitating arms is chosen to that the paddles pass sequentially and not simultaneously over the throat of the slot to prevent pulses or surges of toner into the toner pool formed therebeneath. The rotation rate of the agitating arms preferably lies in the range from 0 to 10 revolutions-per-minute.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
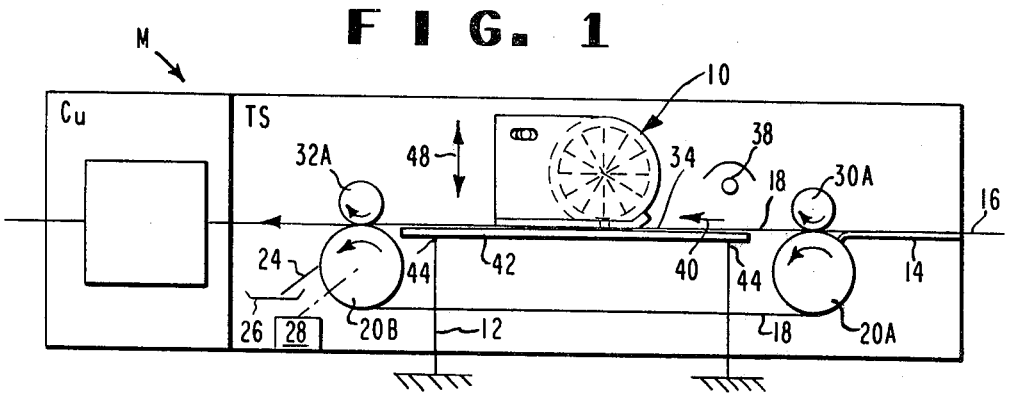
FIG. 1 is a schematic representation of a toner applicating apparatus in accordance with the instant invention shown in the environment of a toning station.

Throughout the following description similar reference numerals refer to similar elements in all figures of the drawings.

In accordance with the instant invention an apparatus for applying particulate toner is generally indicated by reference character 10 and is shown in a schematic form in FIG. 1 in the environment of a toning station indicated by the reference character TS. The toning station TS and the toner applicating apparatus 10 may typically find application in an automatic toning system useful for applying particulate toners to image-defining surfaces made using CROMALIN® proofing film, toners and equipment manufactured by E. I. du Pont de Nemours and Company, Inc. The toner applicating apparatus 10 may be used in connection with both positive and negative acting CROMALIN® proofing film, toners and equipment. Such a toning system would encompass four or more toning modules, one for each color of particulate toner (magenta, cyan, yellow, black and optionally, any color). Each color toning module indicated by reference character M comprises a toning station TS having toner applicating apparatus 10 and an optional toner clean-up apparatus, indicated by reference character CU, disposed adjacent thereto. In practice, individual modules M may be stacked one atop the other in a suitable frame or otherwise arranged in any convenient manner.

The toning station TS includes a main frame 12 (shown schematically) to which the constituent elements thereof are mounted. An inlet shelf 14 is adapted to receive a photo-element 16 which has already been exposed in an image-wise manner and therefore contains areas of tackiness corresponding to the latent images thereon.

The photo-element 16 is introduced onto a transport system, such as an endless belt 18 trained over a driven roller arrangement 20 (shown in the form of a pair of driven rollers 20A and 20B). A belt cleaner wiper 24 and tray 26 may be provided, if desired. The rolls 20 are driven by a suitable roller drive arrangement diagrammatically illustrated and generally indicated in FIG. 1 by reference character 28. Any suitable drive arrangement 28 may be used, such as a Bodine type NSH-11D3 drive, sold by Bodine Electric Co., Chicago, Illinois although other expediments would be apparent to those skilled in the art. It is also within the contemplation of this invention that a photo-element roller drive, having entrance pull rolls and exit pull rolls similar to those disclosed in U.S. Pat. No. 4,069,791, may be used to transport the photo-element 16.

The photo-element 16 is conveyed in the embodiment shown onto the belt 18 by a pair of inlet edge rollers 30. Only one of the pair, inlet edge roller 30A, is shown in FIG. 1. An outlet pair of edge rollers 32, only one of which, outlet edge roller 32A, being visible, is provided at the discharge end of the toning station TS. The edge rollers 30 and 32 are arranged to cooperate with the driven rolls 20 to grasp the photo-element 16 at the edges thereof to prevent damage to the tacky image-wise areas thereon.

The photo-element 16 is conveyed on the upper surface of the endless belt 18 along a transport path generally indicated at 34. The transport path 34 conveys the photo-element 16 from a point inside the inlet edge rollers 30, beneath an optional infrared heater 38, beneath the particulate toner applicator 10, to the outlet edge rollers 32. The direction of conveyance of the photo-element along the transport path 34 is illustrated by the arrow 40. A support plate 42 is mounted to the frame 12 by any suitable attachment 44 and is at least disposed beneath the portion of the transport path 34 in the region of the toner applicator 10 for a purpose to be discussed in more detail herein. Alternatively, if the entrance and exit pull rollers discussed earlier are used, the plate may take the form of a planar support surface having perforations therein, the perforations aiding in removing particulate material on the pile pads by permitting it to fall into a collection chamber (which may have a vacuum take-off) disposed below the support surface. This arrangement is also shown in the above-referenced U.S. Pat. No. 4,069,791.

As a general statement of operation, a photo-element 16 introduced along the transport path 34 is heated by the infrared heater 38 (if one is provided) to enhance the tackiness of the exposed latent image on the surface of the photo-element. Thereafter, the photo-element 16 is conveyed along the transport path 34 on the belt 18 beneath the toner applicator 10 where particulate toner material is applied to substantially the entire surface of the photo-element 16. In accordance with this invention the toner applicator 10 is vibrated in a reciprocated fashion in a vertical direction indicated by arrows 48 toward and away from the transport path 34. As the toner applicator 10 is vibrated particulate toner is dispensed to form a toner pool 50 (FIG. 4) from which pool 50 toner is deposited onto the surface of the photo-element 16 as it passes therebeneath. Thereafter, the particulate toner is "patted" into the photo-element 16 by a suitable toning pad member 109 (FIG. 4) driven by the same reciprocating vibratory action of the toner applicator 10. As noted earlier, a "vertical patting" motion is believed to be the most advantageous for use in embedding particulate toner into the exposed areas of the photo-element 16. Thereafter the photo-element 16 is conveyed through the outlet edge rollers 32 to the cleaning section CU (if one is used) where excess toner material is removed from the surface of the photo-element 16.

With reference to FIGS. 2 through 5 shown are, respectively, a plan view, a side elevation view, a side section view and a bottom view of the toner applicator 10 in accordance with this invention.

The toner applicator 10 includes a hopper generally indicated by reference character 56, the hopper 56 being formed of a split tubular body 58 fabricated of plastic or metal material. The body 58 has front, movable, and rear, fixed, arcuate segments 58M and 58F, respectively. Although the segment 58F is "fixed" with respect to the segment 58M (which is movable with respect to the segment 58F to adjust the dimension of an orifice or slot 68 formed in the hopper, as is fully discussed herein) it is to be noted that the hopper 56 as a whole (including the segments 58M and 58F) is able to be vertically vibrated or oscillated in the directions 48 with respect to the main frame 12 of the apparatus 10.

The segments 58M and 58F of the hopper 56 are disposed between first and second end plates 60A and 60B. Portions of the substantially rectangular end plates 60 extend rearwardlly (in the direction of travel 40 of the photo-element 16) to form wing portions 62 for a purpose discussed herein. The wing portions 62 of the end plates 60 are provided with substantially horizontally extending slots 176 for a purpose made clear herein.

A portion of the top surface of the hopper is removed so that the confronting edges of the arcuate segments 58M and 58F are angularly spaced with respect one to the other to define a hopper inlet opening 65 through which particulate toner material may be introduced into the volume defined on the interior of the hopper 56. The lateral boundaries of the opening 64 are defined by lands 66A and 66B (FIG. 2) which extend between the front and rear segments 58M and 58F, respectively. A suitable cover (not shown) is provided to close the inlet opening 64. The lower confronting edges of the arcuate body segments 58M and 58F are spaced within a relatively close distance (as compared to the inlet opening 64) apart to define an orifice or slot 68 extending throughout the length of the hopper 56 between the end plates 60 in a direction substantially transverse to the transport path 34 along which the photo-element 16 is conveyed. As may be appreciated, the provision of the slot 68 forms the split defining the front and rear segments of the hopper. Adjacent the slot 68, the front, movable segment 58M and the rear, fixed, segment 58F are flattened, as at 70M and 70F, respectively, to define surfaces which extend substantially parallel to the transport path 34 and support plate 42.

The fixed segment 58F of the tubular body 58 is suitably affixed, as by bolts 72, to the end plates 60A and 60B and is rearwardly disposed (in the direction of travel 40 of the photo-element) of the slot 68. The front, movable segment 58M of the hopper 56 is slidable with respect to the conjoined end plates 60 and to the rear, fixed, segment 58F whereby the dimension 68D (FIG. 5) of the slot 68 (measured in the direction 40 of transport) between the vertical edges 68E defining the slot may be varied. As will be seen, the end plates 60 are connected to the frame 12.

Means 76 for varying the dimension 68D of the slot 68 is provided. The means 76 includes a C-shaped angle bracket 78 the arms 78A and 78B of which are bolted, as by bolts 80A and 80B, respectively, to the end plates 60A and 60B. Mounted to the front surface of the segment 58M of the hopper 56 are keepers 82A and 82B. The keepers 82 are transversely aligned with each other and are disposed at substantially each transverse end of the front of the front segment 58M of the hopper 56. The keepers 82 respectively capture the heads 84H and 86H of bolts 84 and 86. The bolt heads 84H and 86H are confined by the keepers such that the bolts are rotatable but not translatable toward or away from the segment 58M. The shaft portions 84S and 86S of the bolts extend through openings 83A and 83B provided in the keepers 82.

The shaft portions 84S and 86S of the bolts extend through openings 88A and 88B provided in the elongated back of the C-shaped bracket 78. The openings 88 are in register with the openings 83 in the keepers. A threaded nut 90A and 90B is respectively secured, as by welding, to the bracket 78 about the respective openings 88 therein. The forward end of the shafts are provided with slots 84T and 86T, respectively, to receive a suitable tool.

When the bolts 84 and 86 are rotated in a first angular direction (by the insertion of a tool into the slots 84T and 86T, respectively,) the bolts 84 and 86 are advanced with respect to the threaded nuts 90 secured to the bracket 78, thus pushing the front segment 58M of the hopper 56 in the direction indicated by arrow 94C to close the dimension 68D of the slot 68. Conversely, when the bolts 84 and 86B are rotated in a counterdirection the bolts are drawn through the threaded nuts 90, thereby drawing the segment 58M in a counterdirection indicated by the arrows 94W, thus widening the dimension 68D of the slot 68. Lock nuts 96 may be provided for each bolt 84 and 86, to prevent loosening of the bolts during operation of the toner applicator 10. Of course, other suitable expedients whereby the dimension 68D of the slot 68 (measured as defined above) extending through the hopper 56 and communicating with the transport path 34 may be effected. These alternatives are to be understood as lying within the contemplation of this invention. Using the structure set forth above, the dimension 68D of the slot 68 may be varied in the range from 0 to 0.25 inches ($0<$dimension 68D$\leqq 0.25$ inches). Preferably, the width of the slot 68 is not less than approximately one-eighth inch (0.13 inches). By splitting the movable segment 58M at a predetermined location along a cutting plane perpendicular to the plane of the transport path and parallel to the direction of transport 40 and by adding to the hopper on each side of the predetermined location additional means for varying the dimension of the slot 68, it is possible to selectively close the slot 68 on one side of the cutting plane while the slot 68 on the other side of the cutting plane remains open. Thus it is possible to apply particulate toner to only that portion of the photo-element which is passed beneath the open portion of the slot.

Extending rearwardly in the direction of transport 40 from the rear, fixed, segment 58F of the tubular body 58 is a bracing plate 98. The plate 98 is shown as integrally formed with the segment 58F, although any suitable construction may be used. For example, the plate may be a separate member, affixed as by gluing to the segment 58F. The bracing plate 98 is suitably affixed to the integrally projecting wing portions 62 from each end plate 60 by suitable bolts 98B to thereby impart structural stability and rigidity to the hopper 56. The lower surface 98L of the plate 98 is co-planar with the flat surfaces 70M and 70F diposed on the segments 58M and 58M of the hopper 56.

Figure 5:
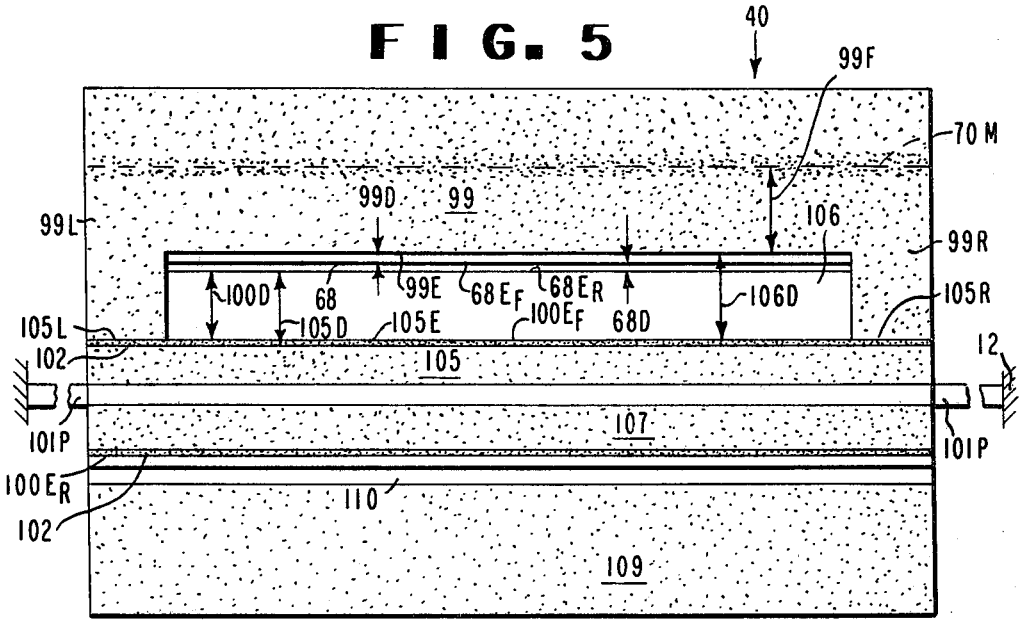
FIG. 5 is a bottom view of the hopper taken along view lines V—V in FIG. 4.

The segment 58M of the hopper 56 is provided with a resilient toning pad 99 which extends around the arcuate exterior surface of the segment 58M below the angle bracket 78 and along the flattened lower section 70M thereof. The edge 99E of the backing of the toning pad 99 lies within a predetermined close distance 99D (FIG. 5) of the adjacent front edge 68E$_F$ of the slot 68. The portion of the pad 99 lying along the flattened lower section 70M of the segment 58M (to the edge 99E of the backing of the pad 99) is indicated in FIG. 5 by reference character 99F. Flaps 99L and 99R extend rearwardly from the pad 99.

A transversely extending recess, or well, 100 (FIG. 4) is formed in the lower surface 70F of the segment 58F. The well 100 accommodates a seal arrangement 101. The space between the seal arrangement 101 and the well 100 is filled with a foam material 102 adhered about the well 100. The front edge 100E$_F$ of the well 100 is spaced a distance 100D (FIG. 5) from the rear edge 68E$_R$ of the slot 68.

The seal arrangement 101 is affixed to the main frame 12 as discussed herein. The seal arrangement 101 includes a baseplate 101B having a downwardly projecting portion 101P thereon. The projecting portion 101P has an inclined front surface 101S thereon, the surface 101S facing upstream in the direction of transport 40. The lateral ends of the projecting portion 101P of the seal arrangement 101 are received in brackets 103 (FIGS. 2 and 3) having vertically extending slots 103S therein. Mounting bolts 104 secure the seal arrangement 101 to the main frame 12. The clearance between the lower end of the projecting portion 101P of the seal arrangement 101 and the photo-element 16 carried along the path of transport is adjustable by loosening the bolts 104 and sliding the brackets 103 along the bolts 104 until the desired clearance is reached. The bolts 104 are then re-secured. The clearance is typically in the range from 0.005 to 0.010 inches, but not less than 0.005 inches. The seal arrangement 101 may be fabricated of stainless steel, rigid plastic, or any other suitable material. The flattened lower front surface 101L$_F$ (FIG. 4) of the baseplate 101B of the seal arrangement 101 is provided with a resilient pad 105 which extends transversely to the direction of transport 40. The vertical edge 105E of the backing of the pad 105 is spaced rearwardly a predetermined distance 105D (FIG. 5) from the rear edge 68E$_R$ of the slot 68. The edges of the flaps 99R and 99L are within a close distance of the edges of the backing of the pad 105 along seams 105R and 105L respectively to totally enclose the slot 68 frontwardly, rearwardly and laterally. The confronting edges 99E and 105E of the backing of the pads 99 and 105 in the vicinity of the slot 68 define an opening 106 having a dimension 106D sufficient to encompass the dimension 68D of the slot 68. The opening 106 is transversely co-extensive with the slot 68. It will be appreciated that since the pad 99 is affixed to the front, movable, segment 58M, the dimension 106D of the opening 106 will at all times be greater (measuring the direction of transport 40) than the dimension 68D of the slot 68. The flattened lower rear surface 101L$_R$ of the baseplate 101B is provided with a resilient pad 107.

Spaced rearwardly of the pad 107 is another resilient toning pad 109. The pad 109 is mounted to the lower surface 98L of the brace plate 98. The pads 107 and 109 may be separated, if desired, by a vacuum opening 110 extending through the brace plate 98. The opening 110 may be connected to a suitable aspiration device 111 (FIG. 4) such as a home, shop, wet dry vacuum cleaner sold by Sears, Roebuck and Co. under model number 75817851.

Figure 4:
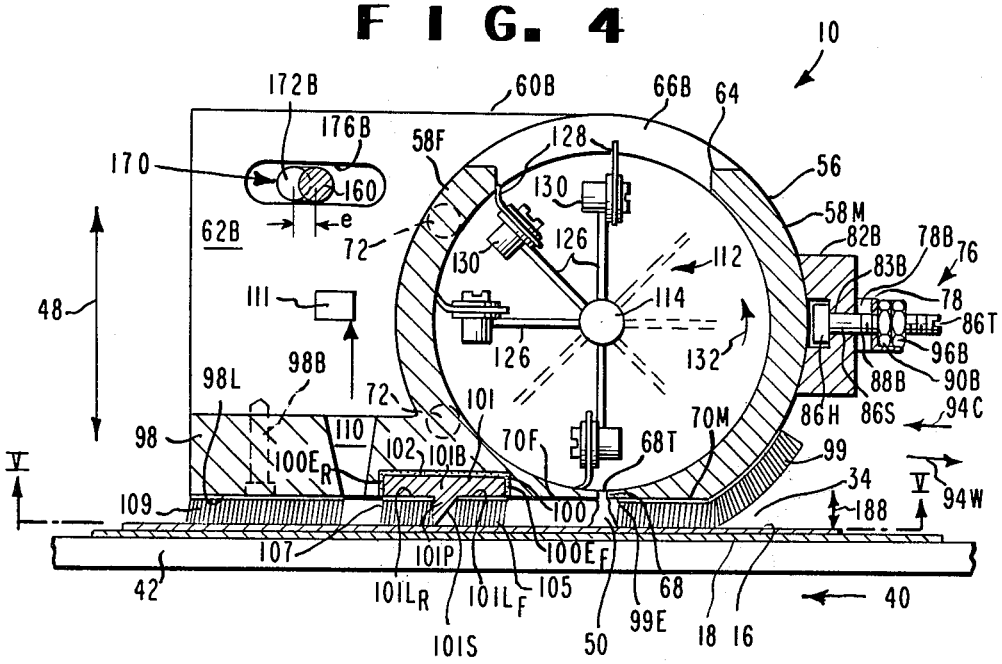
FIG. 4 is a section view of the hopper taken along section lines IV—IV of FIG. 2.

Although 100% mohair is preferred, the resilient pads 99, 100, 107 and 109 may be fabricated of any suitable pile fabric material so long as that fabric material exhibits the characteristics of resiliency, low abrasion factor and static control. It is noted that the pile fabric used in the pads 99, 100, 107 and 109 is shown in FIG. 4 as inclined from the vertical in the direction of transport 40. The angle of inclination is typically approximately twenty degrees. Each of the pads 105 and 107 (on the seal arrangement 101) extends at least three-eighths to no greater than one-half inch (in the direction of transport) (three-eighths $\leqq$ seal dimension $\leqq$ one-half inch). The toning pad 109 on the brace plate 98 extends at least one inch in the direction of transport.

As an optional feature, extending centrally and axially through the interior of the hopper 56 is an agitator 112 having a rotatable shaft 114. The shaft 114 is mounted in suitable bearings 116 provided about openings disposed in the end plates 60A and 60B. One end of the shaft 114 projects transversely past the end plate 60A and is provided with a driven pulley 118 which is connected by a belt 120 to a drive motor (not shown). The drive motor is mounted to the frame 12 by a suitable bracket (not shown) or any other suitable expedient. The drive motor rotates the agitator 112 at an agitation rate in the range from 0 to 10 revolutions-per-minute (r.p.m), preferably in the range from four to eight r.p.m.'s. Suitable for use as the motor is a device sold by W. W. Granger Inc., Chicago, Illinois under model Granger 3M 104.

Figure 6:
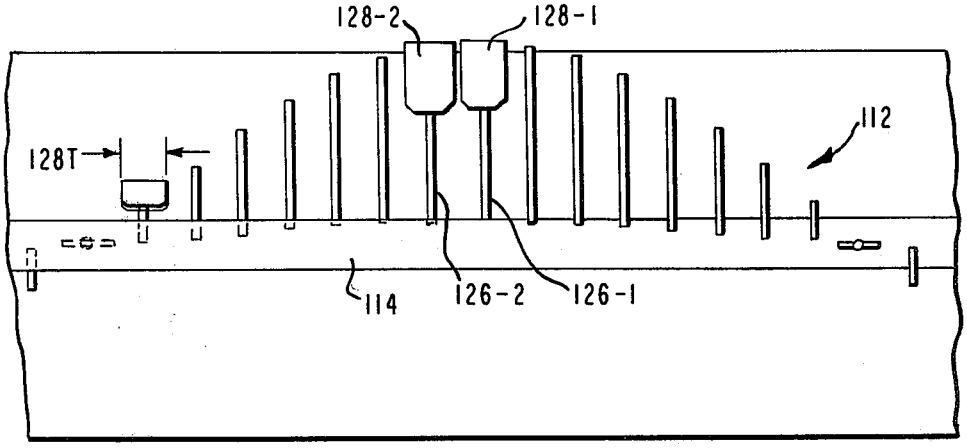
FIG. 6 is a front view of an optional agitator in accordance with the instant invention illustrating the helical pattern formed by the radiating agitating arms thereof.
Figure 7:
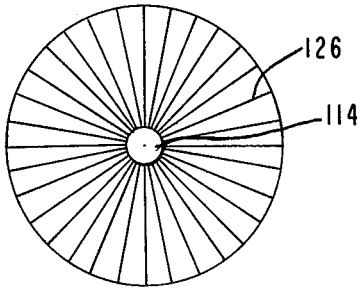
FIG. 7 is a side view of the agitator shown in FIG. 6.

Extending radially outwardly (see FIG. 7) from the shaft 114 is an array of agitating arms 126 each terminating in a resilient wiping flapper, or paddle, 128 suitably attached as by bolts 130 to the arms 126. The radial outermost dimension from the axis of the shaft 114 to the tips of the resilient paddles 128 is greater than the inner radius of the hopper 56. The paddles 128 are formed of MYLAR ® polyester film manufactured by E. I. du Pont de Nemours and Company, Inc., although any suitable flexible material may be used. As a result, when the agitator is driven, the paddles are rotated in a counter clockwise direction 132 within the hopper 56 and wipe the inside surface thereof. As seen in FIG. 6, the agitator arms 126 are arranged in opposed helices originating from a point substantially centrally of the length of the shaft 114 and spiral about the shaft 114 transversely toward each end plate 60. The agitator 112 when rotated serves to agitate the particulate toner disposed on the interior of the hopper 56 to prevent particle size stratification of the particulate matter. With vibration of the hopper 56, size stratification, or settling, of toner particles within the hopper 56 may occur. The opposed helical arrangement (FIG. 6) of the agitating arms 126 and the paddles 128 is selected so that different ones of the paddles 128 pass over the throat 68T of the slot 68 on the interior of the hopper 56 in a predetermined selective fashion thus preventing the pulsating application of toner to the toner pool 50 and to the photo-element. The agitation tends to assist in the fluidization of toner particles within the hopper 56.

As seen also from FIG. 6, the transverse dimension 128T of each paddle 128 is arranged so that the entire inner surface of the hopper 56 is swept as the agitator rotates therewithin. To achieve this result, the edges of angularly adjacent paddles abut or overlap in the transverse direction, as illustrated by the paddles 128-1 and 128-2 in FIG. 6. Any suitable number of angularly spaced agitating arms 126 with paddles 128 may be used. With a hopper 56 having a transverse dimension of twenty-nine inches, sixty arms 126 and paddles 128 have been preferably utilized. The helical arrangement of arms 126 and paddles 128 is desired since the paddles are thereby angularly displaced and impact in a selected sequential, that is, nonsimultaneous manner, over transversely spaced portions of the throat of the slot so that surges of toner into the pool (which would tend to occur if the paddles impact simultaneously across the throat) are avoided.

Substantially U-shaped suspension springs 142A and 142B are bolted, as by bolts 144, with the open part of the U facing upwardly, between the outside lower surfaces of the end plates 60 and the inside surface of the main frame 12 confronting the same. The arm of the U abutting the frame 12 is slotted, as at 148, for a purpose discussed herein. The springs 142 provide a resilient connection whereby vibratory motion may be imparted to the hopper 56 so that it may be reciprocated in the oscillating direction 48 toward and away from the transport path 34. The springs are fabricated from spring stainless steel. Of course, any suitable suspension spring arrangement may be utilized.

A reciprocating device, or vibrator, generally indicated by reference character 150 is arranged to impart vibratory motion to the hopper 56. The vibrator 150 includes a motor 152 such as that sold by Bodine Electric Co., Chicago, Illinois as type 42D3BEPM, under model number 02BFB901. The motor 152 is mounted on a bracket 154 adjustably connected to the frame 12 by bolts 156. The bolts 156 extend through a vertical slot 158 provided in the bracket 154. The heads of the bolts 156, when secured to the frame 12, abut the exterior of the bracket 154 to hold the bracket against the frame. The shaft 160 of the motor 152 extends through openings 162A and 162B provided on each side of the frame 12. Bearing blocks 164A and 164B, such as those manufactured by Boston Gear Co., Quincy, Massachusetts and sold under model PS2, support the shaft 160 for rotation. The bearing blocks 164 are vertically adjustable by virtue of pairs of slots 166A and 166B which lie above and below the openings 162 in the frame 12. The blocks 164 are adjustably secured to the frame 12 by pairs of bolts 168A and 168B which are received in the slots 166.

The reciprocating device 150 is connected to the hopper 56 through a Scotch yoke assembly generally indicated by reference character 170.

The Scotch yoke assembly 170 includes followers 172A and 172B (FIGS. 2 and 4) secured at substantially transverse locations of the shaft 160. The followers 172 are captured in the slots 176A and 176B, respectively.

Figure 2:
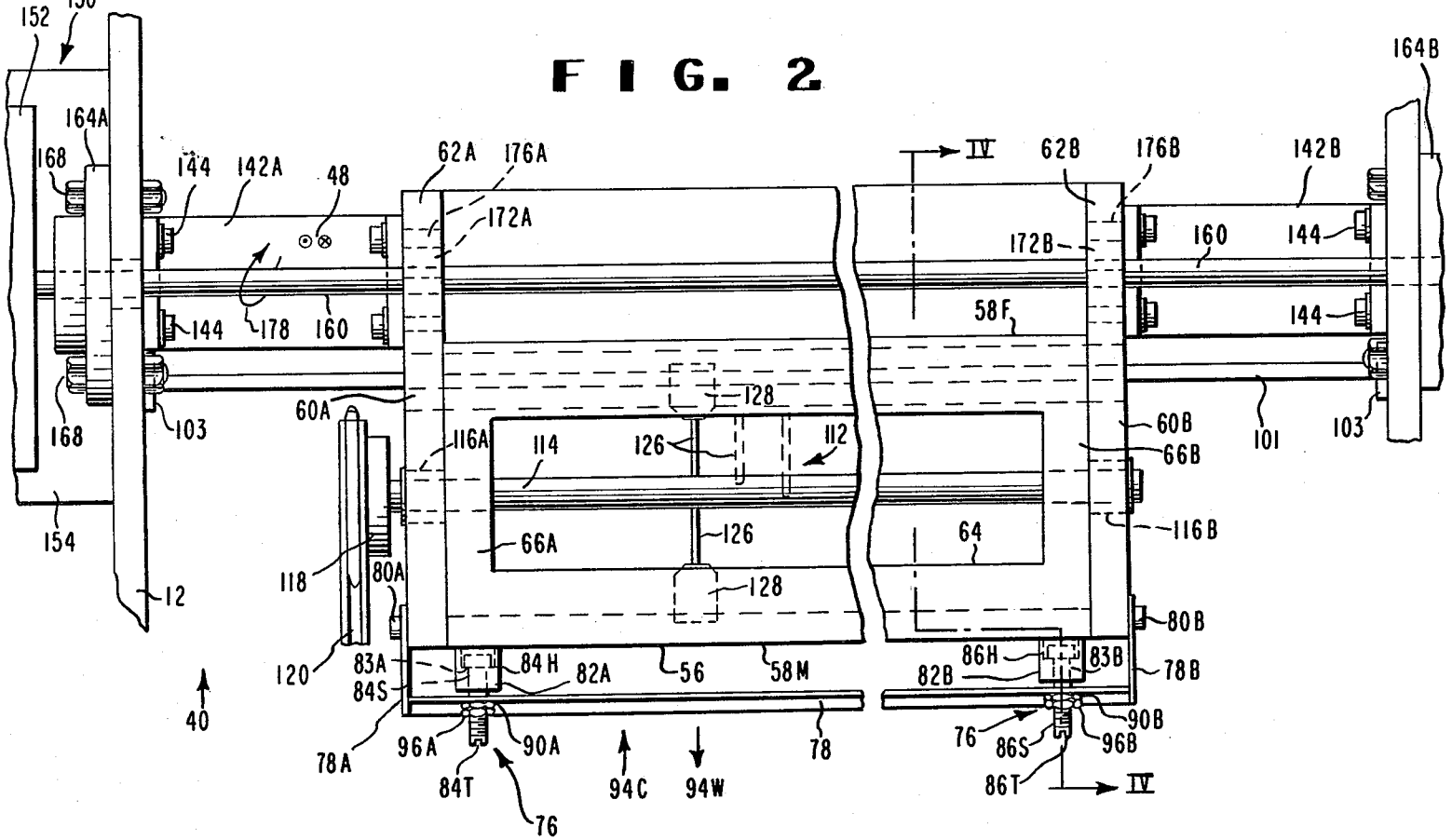
FIG. 2 is a plan view of the hopper used in connection with the toner applicating apparatus of FIG. 1.

The Scotch yoke assembly 170 is operative to convert the rotary motion of the shaft 160 (driven by the motor 152 and illustrated by reference arrows 178, FIG. 2) into reciprocating rectilinear motion in the vertical direction 48 to vibrate the hopper 56. The vertical direction 48 may be more generally defined as a direction perpendicular to the plane containing the transport path of the photo-element through the apparatus. The Scotch yoke assembly has been known for use as the driving unit, or forcing function, for vibrating or shaking tables. The Scotch yoke assembly is arranged such that the uniform angular rotation (in the direction 178) of the motor 152 is transformed into simple harmonic reciprocation of the hopper 56 (in the direction 48). The vibration of the hopper is facilitated by the suspension springs 142. The Scotch yoke oscillating assembly is chosen for its compactness and, more importantly, for its ability to provide a true simple harmonic oscillatory motion to the hopper 56. Depending upon the eccentricity e (FIG. 4) of the followers 172 on the shaft 160, the amplitude (peak-to-peak) of the oscillation may be controlled. In the embodiment of the invention shown in the figures in which the same oscillatory motion imparted to the hopper is also used to provide a vertical patting motion to embed the toner into the photo-element 16, the amplitude (peak-to-peak) of the oscillatory reciprocating motion of the hopper in the range from 0.020 to 0.050 inches, ($0.020 \leqq \text{amplitude} \leqq 0.050$ inches) with the preferred amplitude being 0.030 inches. If the oscillatory motion is used only to fluidize the toner in the hopper 56, the amplitude (peak-to-peak) may lie in the range from zero to 0.150 inches, ($0 < \text{amplitude} \leqq 0.150$ inches) preferably in the range from 0.020 to 0.100 inches ($0.020 \leqq \text{amplitude} \leqq 0.100$ inches) and most preferably, 0.030 inches.

Figure 3:
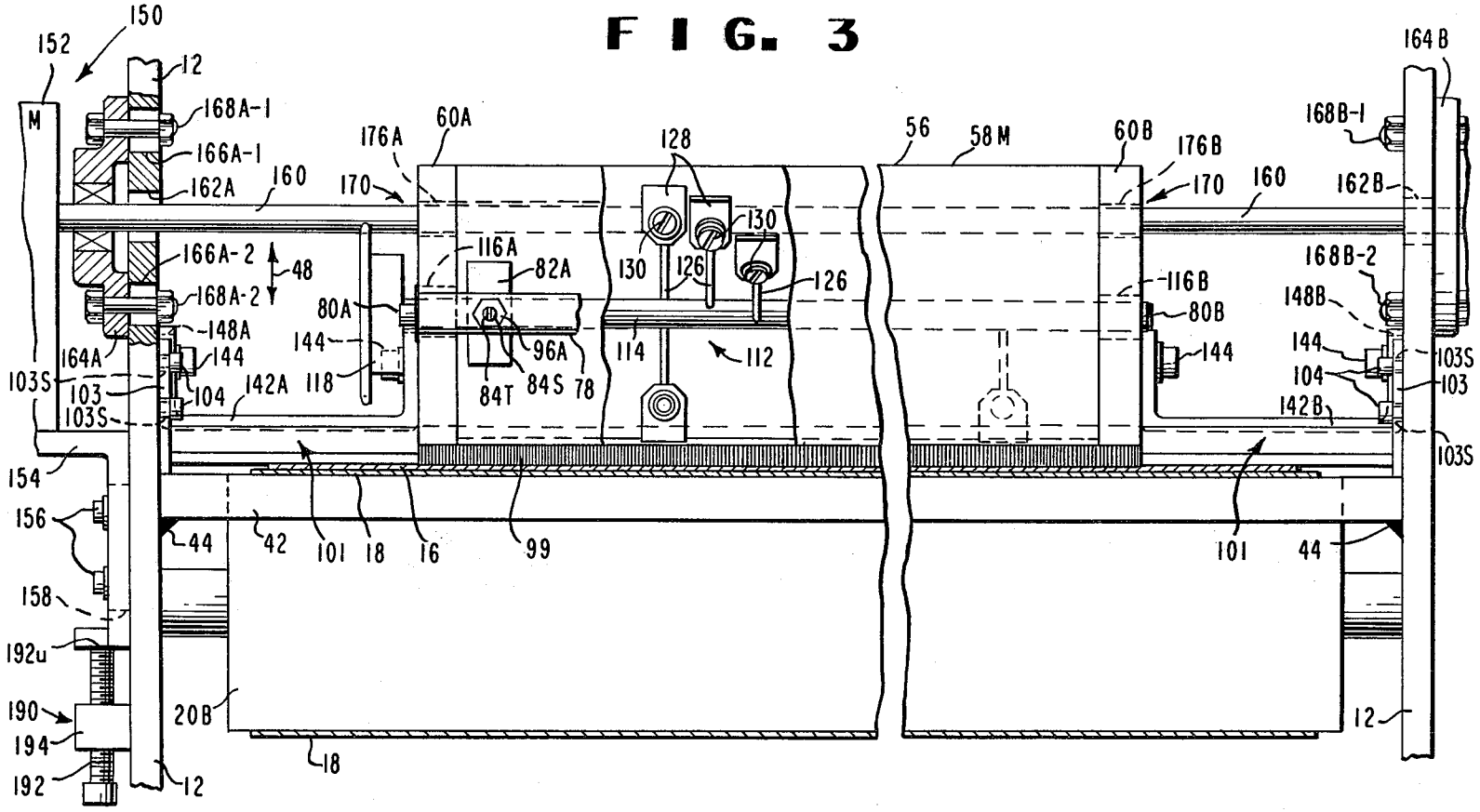
FIG. 3 is a front elevation view of the hopper shown in FIG. 2.

The lower edges of the resilient toning pads 99 and 109 are adjusted to slightly contact the surface of the photo-element 16 carried by the belt 18 along the transport path 34 beneath the hopper 56 through the provision of the height adjustment mechanism 190 (FIG. 3). The height adjustment mechanism 190 includes an adjustment screw 192 threadedly connected into a bracket 194 secured to the exterior of the frame 12. The upper end 192U of the adjustment screw 192 abuts against the lower end of the bracket 154 on which the motor 152 is mounted. With the Scotch yoke follower 172 rotated to the upstroke (top dead center) position the bolts 148 (holding the springs 142), the bolts 156 (holding the bracket 154) and the bolts 168 (holding the bearing blocks 164) are loosened. Due to the provision of the slots 146 (in the springs 142), the slot 158 (in the bracket 154) and the opening 162 and the slots 166 (for the shaft 160 and the bolts 168, respectively) the hopper 56 may be raised or lowered as desired so that the lower edges of the pile fabric of the pads 99 and 109 slightly contact the surface of the photo-element 16 (with the Scotch yoke at top dead center position). Thereafter, the bolts 148, the bolts 156 and the bolts 168 are resecured to firmly affix the springs 142, the bracket 154, and the bearing blocks 164 to the frame 12.

In operation, the rotary energy of the motor 152 is converted to a reciprocating rectilinear vibratory motion and is imparted to the hopper 56 through the Scotch yoke assembly 170 to thereby cause oscillating reciprocating vibratory motion in the vertical direction 48 of the hopper 56 and of the particulate toner contained therein. The frequency of oscillation is controlled by the electrical parameters of the motor 152. When the oscillatory motion imparted to the hopper 56 is only to fluidize the toner therein, the frequencies lies in the range from zero to 50 Hertz ($0<\text{frequency}\leqq 50$ Hertz) preferably in the range from 30 to 50 Hertz, ($30\leqq\text{frequency}\leqq 50$ Hertz) and most preferably 40 Hertz (2400 cycles per minute). If the oscilatory motion is also to be used to vertically pat the toner into the photo-element, the frequency lies in the range from 20 to 50 Hertz, ($20\leqq\text{frequency}\leqq 50$ Hertz) and preferably 40 Hertz. The amplitude (peak-to-peak) of vibration is controlled by the degree of eccentricity e of the followers 172 in relation to the shaft 160.

To summarize, to both fluidize and vertically pat black, yellow, cyan and/or magenta toners, it has been found that a frequency of oscillation in the range from 20 to 50 Hertz ($20\leqq\text{frequency}\leqq 50$ Hertz), with a peak-to-peak amplitude in the range from 0.020 to 0.050 inches ($0.020\leqq\text{amplitude}\leqq 0.050$ inches) is desirable. In such a case, the preferred frequency is 40 Hertz (2400 cycles per minute) and the preferred amplitude is 0.030 inches. These amplitudes and frequencies are best adapted to fluidize the particulate toner disposed within the hopper 56 and to cause the toner to flow through the slot 60 and opening 102 to form the pool 50 (FIG. 4) of toner in the region along the transport path 34 above the photo-element 16 and below the hopper 56 and also to pat the toner into the photo-element. By "fluidize" it is meant that the toner particles will flow through the orifices 68 and 106 without bridging, caking or agglomerating.

The pool 50 extends transversely of the transport path 34 and is coextensive with the transverse dimension of the slot 68 (and of the space 106) between the lateral flaps of the pad 99. It has been found that toner particles are highly fluidized in that portion of the pool immediately adjacent to the slot 68. However, as the distance from rear edge 68$E_R$ of the slot 68 increases toward the edge 105E of the pad 105, the toner particles tend to become agglomerated. This tendency is believed beneficial since the toner is fluid in that area where it first contacts the photo-element (i.e., in the vicinity beneath the slot) and since the agglomeration of toner near the pad 105 tends to decrease the energy of the toner particles, thus aiding the sealing effect of the seal arrangement 101. The dimension 100D (FIG. 5) must not be less than 0.5 inches, while the dimension 105D is on the order of 0.5 inch. The dimension 99D is not less than approximately one-eighth inch (0.13 inches). The dimension 99F (FIG. 5) should be equal to or greater than three-fourths inch and equal to or less than one inch ($0.75\leqq\text{dimension } 99F\leqq 1.00$ inch). The presence of the seal arrangement 101 (and the pads 105 and 107 disposed thereon) prevents the migration of excessive toner from the pool 50 to the resilient toning pad 109. The opening 110, if provided, may be connected to a low pressure region to aspirate any toner particles able to migrate thereto, thus further isolating the resilient pad 109 from the pool.

Once the mohair in the pad 109 has been initially conditioned it is possible to achieve a steady state toner flow condition wherein the amount of toner taken from the pool 50 formed beneath the slot 68 and deposited on the photo-element 16 as it moves along the transport path 34 therethrough will be closely matched by the replenishment flow of toner from the hopper 56 into the pool 50. In this manner a full, even application of toner particles throughout the transverse width and length of the photo-element 16 may be achieved. By "conditioned" it is meant that a toner deposition in the pile fabric of the pad 109 similar to that encountered during steady state processing conditions has been achieved.

As the photo-element carrying the toner particles thereon passes along the transport path 34 under the hopper 56, toner particles are deposited thereon. Further conveyance of the photo-element 16 along the transport path 34 disposes the photo-element beneath the toning pad 109 where the vibratory motion imparted to the hopper 56 also serves to bring the toning pad 109 into engagement with the photo-element 16. With a "vertical patting" motion, the toner particles deposited on the surface of the photo-element 16 as it passed through the toner pool 50 are embedded into the surface of the photo-element.

It is in the region where the toner is embedded into the tacky surfaces of the photo-element 16 by the toning pad 109 that the presence of the support plate 42 is important. The support surface provided by the plate 42 must be substantially planar (i.e., nonundulating and flat) to prevent discontinuity of toner application and to provide a base against which the toner may be evenly patted into the surface of the photo-element 16.

From the foregoing those skilled in the art will recognize that a toner applicator is disclosed which includes a hopper adapted to receive a charge of particulate toner material. The hopper is suspended in a manner such that oscillating motion in a vertically reciprocating rectilinear direction may be imparted to the hopper to fluidize the particulate matter therein and cause fluidized particulate toner to flow through a slot defined in the hopper. The toner forms a pool extending transversely of the transport path of a photo-element being conveyed therealong. As the photo-element passes beneath the hopper, toner from the pool is deposited onto the surface of the photo-element. The oscillating reciprocating vertical motion applied to the hopper additionally serves to impart a "patting" motion to a toning pad to pat and evenly embed particulate toner into the surface of the photo-element when the photo-element is conveyed thereunder. A plate, disposed beneath the transport path vertically opposite the toning pad, provides a flat, stable surface and serves as a backing against which the photo-element is supported as the toner is patted into the photo-element. The stationary (with respect to the oscillating hopper) seal prevents excessive toner migration to the toning pad.

Those skilled in the art, once having the benefit of the teachings hereinabove set forth may effect numerous modifications thereto. It is to be understood, however, that such modifications lie within the contemplation of this invention, the scope of which is defined by the appended claims.

What is claimed is:

1. Apparatus for applying a particulate toner to an image-defining tacky surface on a photo-element comprising:

means for transporting a photo-element along a predetermined transport path;

a hopper for receiving particulate toner therein, the hopper being spaced above the transport path and having a slot therein communicating with the transport path, the slot having a predetermined dimension measured in the direction of travel of the photo-element along the transport path;

a reciprocating device for vertically moving the hopper as a whole in a reciprocating fashion toward and away from the transport path to impart vibrational energy to the toner to fluidize the same to cause it to flow through the slot to form a toner pool from which pool toner is depositable on a photo-element transportable therebeneath, the reciprocating device imparting an oscillatory motion to the hopper at a frequency in the range from 0 to 50 Hertz ($0<\text{frequency}\leqq 50$ Hertz), and at an amplitude (peak-to-peak) in the range from 0 to 0.150 inches ($0<\text{amplitude}\leqq 0.150$ inches);

a toning pad disposed downstream of the pool in the direction of travel of the photo-element, the pad being attached to the hopper for reciprocating movement therewith; and a flat toning support surface disposed vertically opposite the pad and beneath the transport path, the toning support surface serving to support the photo-element while the reciprocating oscillatory motion of the hopper is transmitted to the pad such that the pad pats into the photo-element toner that has been deposited from the pool onto the photo-element.

2. Apparatus according to claim 1 wherein the frequency is 40 Hertz and the amplitude is 0.030 inches.

3. The apparatus according to claim 1 wherein the hopper is split into a first and a second segment and means are provided to move the first segment of the hopper with respect to the second segment thereof to vary the dimension of the slot.

4. Apparatus according to claim 1 further comprising an agitator disposed within the hopper for agitating the particulate toner received within the hopper.

5. Apparatus according to claim 4 wherein the agitator comprises: a central shaft extending through the hopper and having agitating arms extending radially outwardly of the shaft, the arms being arranged in a helical pattern around the shaft; and means for rotating the shaft.

6. The apparatus according to claim 5 further comprising a flapper member disposed at the radially outward end of each arm, the flapper members being flexible and adapted to wipe the inside surface of the hopper as the shaft rotates within the hopper.

7. Apparatus according to claims 2 or 3 further comprising means for varying the vertical distance of the hopper above the transport path.

8. Apparatus according to claim 1 wherein the reciprocating device imparts a true simple harmonic oscillatory motion to the hopper.

9. Apparatus according to claim 1, further comprising a stationary seal arrangement disposed intermediate between the slot and the pad.

10. Apparatus according to claim 9 wherein the seal further comprises a second pad disposed upstream of the seal in the direction of travel of the photo-element.

11. Apparatus according to claim 10 wherein the seal further comprises a third pad disposed downstream of the seal in the direction of travel of the photo-element.

12. Apparatus according to claim 9 further comprising a slot disposed intermediate the seal element and the pad.

13. Apparatus according to claim 11 further comprising an opening disposed intermediate the seal element and the first pad and means for aspirating toner connected to the opening.

14. In an apparatus including a main frame, means for transporting a photo-element having an image-defining tacky surface along a predetermined transport path and a hopper for particulate toner movably mounted on the frame above the transport path, the hopper having a slot therein, the improvement comprising:

guide means for limiting movement of the hopper to vertical reciprocation toward and away from the support;

a reciprocating device attached to the hopper for its vertical reciprocation to impart vibrational energy to the toner to fluidize the same to cause it to flow through the slot to form a toner pool from which pool toner is depositable on a photo-element transportable therebeneath, the reciprocating device reciprocating the hopper at a frequency in the range from 0 to 50 Hertz ($0<\text{frequency}\leqq 50$ Hertz), and at an amplitude (peak-to-peak) in the range from 0 to 0.150 inches ($0<\text{amplitude}\leqq 0.150$ inches); and a toning pad disposed downstream of the pool in the direction of travel of the photo-element, the pad being attached to the hopper for reciprocating movement therewith;

a flat toning support surface on the frame disposed vertically opposite the pad and beneath the transport path, the flat support surface serving to support the photo-element while the reciprocating oscillatory motion of the hopper is transmitted to the pad such that the pad pats into the photo-element toner that has been deposited from the pool onto the photo-element.

15. The apparatus of claim 14 wherein the hopper has a tubular body, end plates, and an opening above the slot for receiving toner, the slot being substantially parallel to the axis of the tubular body.

16. The apparatus of claim 15 wherein is provided a rotary agitator within the body.

17. The apparatus of claim 16 wherein the agitator includes a shaft extending between the end plates and a plurality of flapper members projecting from the shaft, successive flapper members being radially spaced.

18. The apparatus of claim 17 wherein the flapper members are helically disposed in opposite directions from a mid-point on the shaft.

19. The apparatus of claim 14 wherein the body is flexible, the slot extends through the length of the body and means is provided for flexing the body to vary the width of the slot.

20. Apparatus according to claim 1 wherein the frequency of the oscillatory motion is from 20 to 50 Hertz ($20\leqq\text{frequency}\leqq 50$ Hertz) and the amplitude of the oscillatory motion is from 0.020 to 0.050 inches ($0.020\leqq\text{amplitude}\leqq 0.050$ inches).

21. Apparatus according to claim 5 further comprising means for varying the vertical distance of the hopper above the transport path.

22. Apparatus according to claim 6 further comprising means for varying the vertical distance of the hopper above the transport path.

* * * * *